US011957241B2

(12) United States Patent
Rivera, Jr.

(10) Patent No.: US 11,957,241 B2
(45) Date of Patent: Apr. 16, 2024

(54) COLLAPSIBLE MOBILE DESK

(71) Applicant: Anthony Rivera, Jr., Houston, TX (US)

(72) Inventor: Anthony Rivera, Jr., Houston, TX (US)

( * ) Notice: Subject to any disclaimer, the term of this patent is extended or adjusted under 35 U.S.C. 154(b) by 383 days.

(21) Appl. No.: 16/877,163

(22) Filed: May 18, 2020

(65) Prior Publication Data

US 2021/0353048 A1 Nov. 18, 2021

(51) Int. Cl.

| | |
|---|---|
| ***A47B 3/14*** | (2006.01) |
| ***A47B 39/06*** | (2006.01) |
| ***A47B 91/00*** | (2006.01) |

(52) U.S. Cl.

CPC ..... *A47B 3/14* (2013.01); *A47B 39/06* (2013.01); *A47B 91/002* (2013.01); *A47B 2003/145* (2013.01); *A47B 2200/0035* (2013.01)

(58) Field of Classification Search

CPC ..... A47B 3/14; A47B 39/06; A47B 91/002; A47B 2003/145; A47B 2200/0035

USPC ..... 297/174 R

See application file for complete search history.

(56) References Cited

U.S. PATENT DOCUMENTS 2,421,127 A 5/1947 Peckham
2,782,837 A 2/1957 Munsch
2,817,170 A * 12/1957 Skelton ..... D06F 81/02 D32/66
2,973,803 A * 3/1961 Mickelson ..... A47B 3/14 297/170
3,178,220 A 4/1965 Kaake
3,420,571 A * 1/1969 Moore ..... A47B 3/14 297/135
4,067,606 A * 1/1978 Desmoulins nee Fouchereau ..... B62B 3/1472 297/239
4,111,482 A 9/1978 Jones
4,392,685 A * 7/1983 Leonhart ..... A47C 1/14 297/320
4,659,142 A * 4/1987 Kuchinsky, Jr. ..... B62B 1/12 297/118
4,798,411 A 1/1989 Lin
5,356,160 A * 10/1994 Urlwin ..... A47C 7/006 297/188.08
5,356,197 A * 10/1994 Simic ..... A47C 13/00 280/204
5,669,659 A * 9/1997 Dittmer ..... A47C 13/00 D34/24
5,685,602 A 11/1997 Williams
5,820,208 A 10/1998 Miklinevich
5,882,070 A * 3/1999 Genn ..... A47B 97/04 312/231
6,010,186 A * 1/2000 Tsay ..... A47B 39/06 297/173
6,557,867 B1 * 5/2003 Angstadt ..... B62B 1/12 280/30

(Continued)

*Primary Examiner* — Daniel J Troy
*Assistant Examiner* — Timothy M Ayres
(74) *Attorney, Agent, or Firm* — Keana Taylor

(57) ABSTRACT

A mobile desk system that allows for the transportation of a seat, a desk, and additional materials by a single user. The desk and associated chair combine to form a transportation unit that can be operated by a user with one hand. The transportation unit can also carry additional equipment. Once the transportation unit is at the desired location, the equipment is offloaded and the desk and chair are set up per the user's needs.

9 Claims, 13 Drawing Sheets

(56) References Cited

U.S. PATENT DOCUMENTS

| | | | |
|---|---|---|---|
| 8,820,826 | B2 | 9/2014 | Dickey et al. |
| 9,066,584 | B2 | 6/2015 | Li |
| 9,456,684 | B1 | 10/2016 | Frankel et al. |

* cited by examiner

COLLAPSIBLE MOBILE DESK

BACKGROUND

As wireless interconnectivity has increased, activities that were previously confined to locations such as offices and classrooms can now occur elsewhere. Users no longer need to sit at an office desk with a hard line connected to the Internet. Users frequently use mobile devices to connect to the Internet and work at various locations. While wireless technology allows use of a computer anywhere, it does not mean that all places have furniture that facilitates such use.

The minimal furniture needed in such situations includes a desk and a chair. Portable furniture has been available, but it typically is not designed for ease of transport. Further, a user transporting the furniture might need to also transport their computer or other equipment. Existing solutions for this problem requires a user to make multiple trips to transport both the furniture and their equipment.

BRIEF SUMMARY OF INVENTION

A need has arisen for a way to transport a chair and desk to a location for a user to perform various tasks. Transporting a desk and chair is cumbersome since even collapsible chairs and desks need to be transported as separate units. Therefor, there exists a need to transport a collapsible desk and collapsible chair in a more efficient manner. The invention allows a chair and a desk to be transported and deployed at various locations with minimal support. This overcomes the previously discussed issues with separately transporting a desk and chair to a location. The invention comes in multiple exemplary embodiments.

One element of the invention is a chair, which has two primary configurations-deployed and collapsed. When deployed, the chair can support a user. When collapsed, the chair may be transported as described below. Another element of the invention is a desk, which has two primary configurations-deployed and collapsed. When deployed, the desk can support the needed items for the user to work. When collapsed, the desk may be transported as described below.

When both the desk and chair are deployed, they may be placed in any position that allows the user to utilize both items. These devices may be free standing or connected by a support. When both the desk and chair are collapsed, they are connected in a manner that allows transport in the same manner as that of a hand truck. These advantage will be explained more fully below.

DETAILED DESCRIPTION

Overview

Figure 1A:
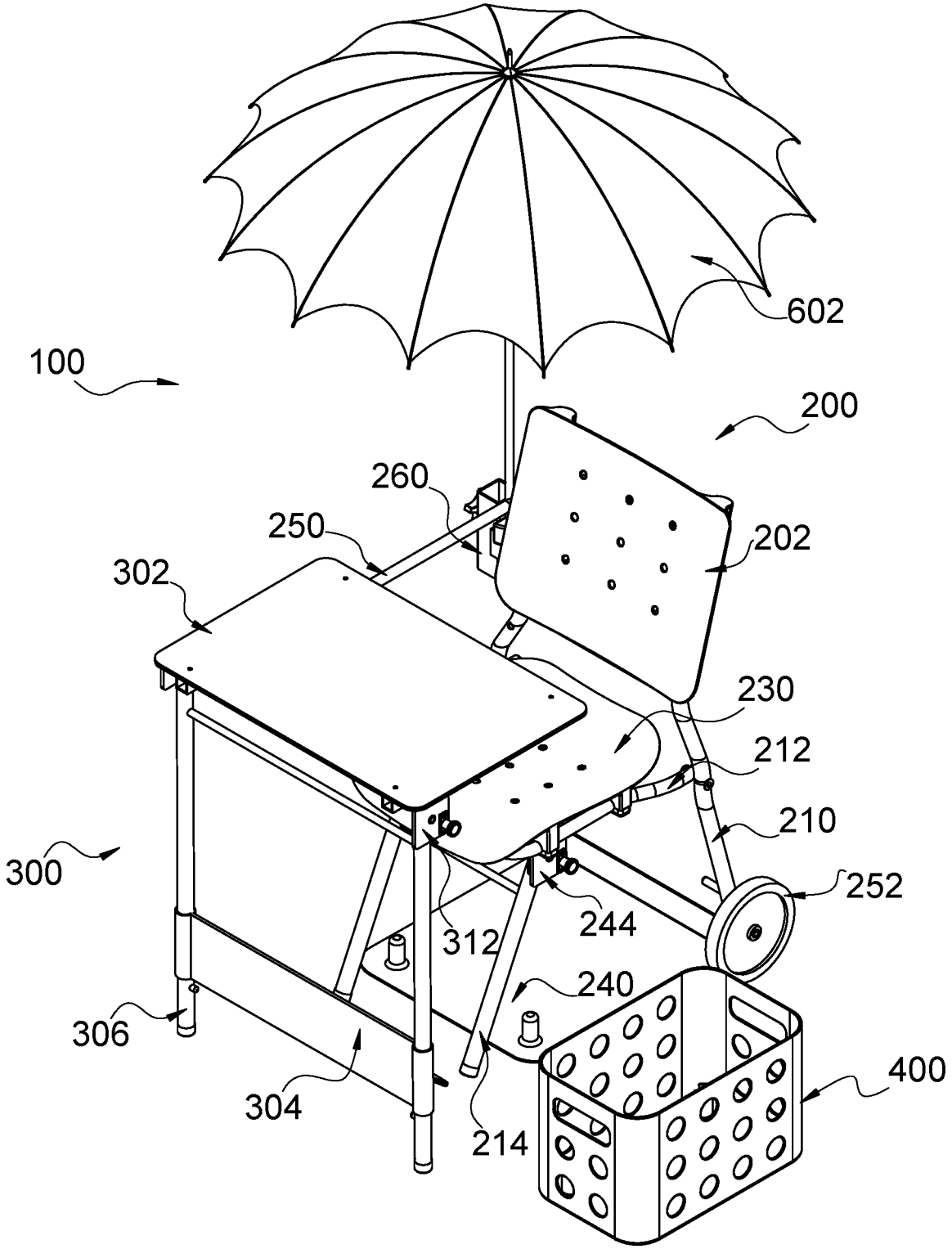
FIG. 1*a* is a perspective view of the mobile desk system in a flat desk configuration in an exemplary embodiment.
Figure 1B:
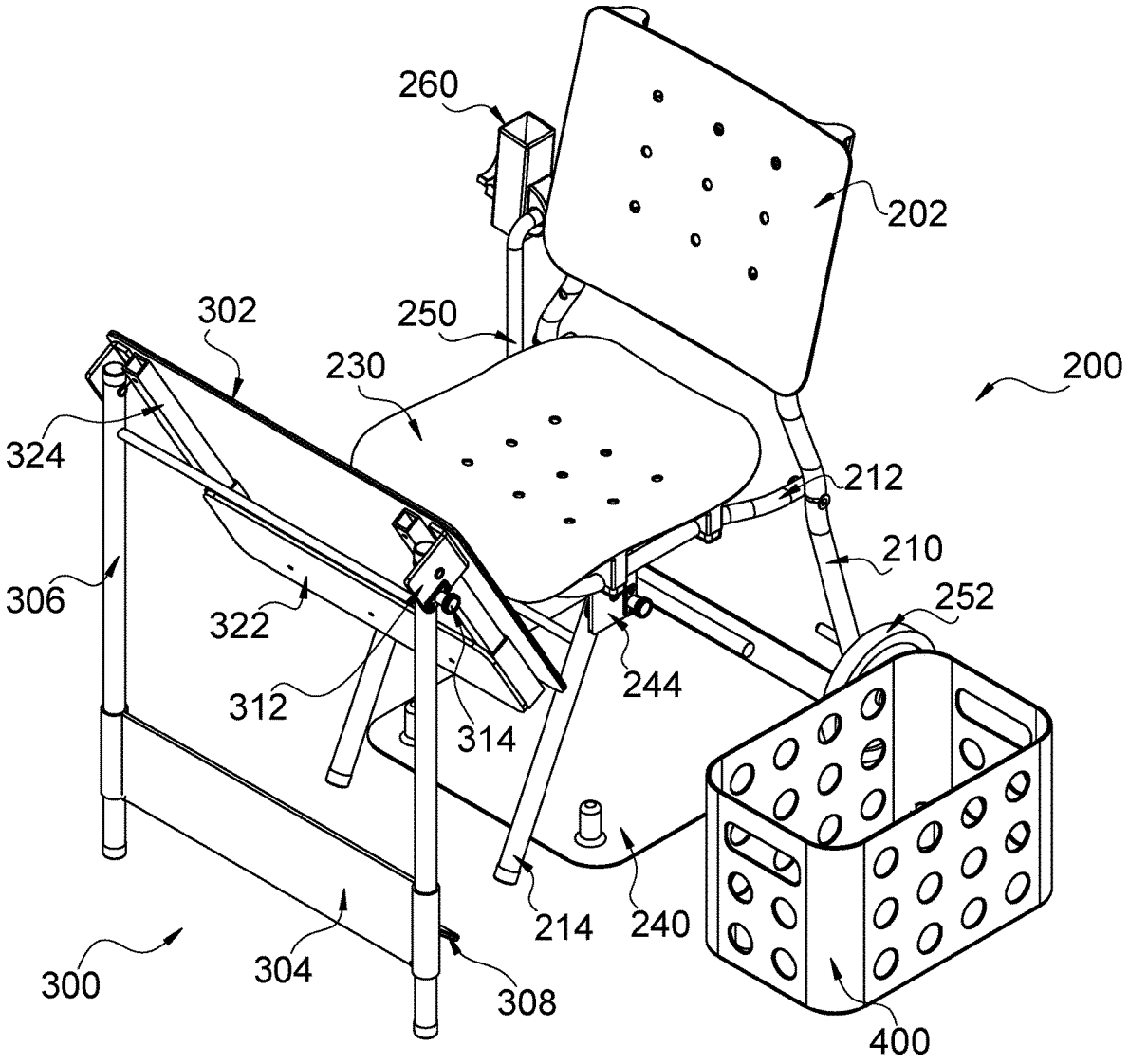
FIG. 1*b* is a perspective view of the mobile desk system in an angled desk configuration in an exemplary embodiment.
Figure 5:
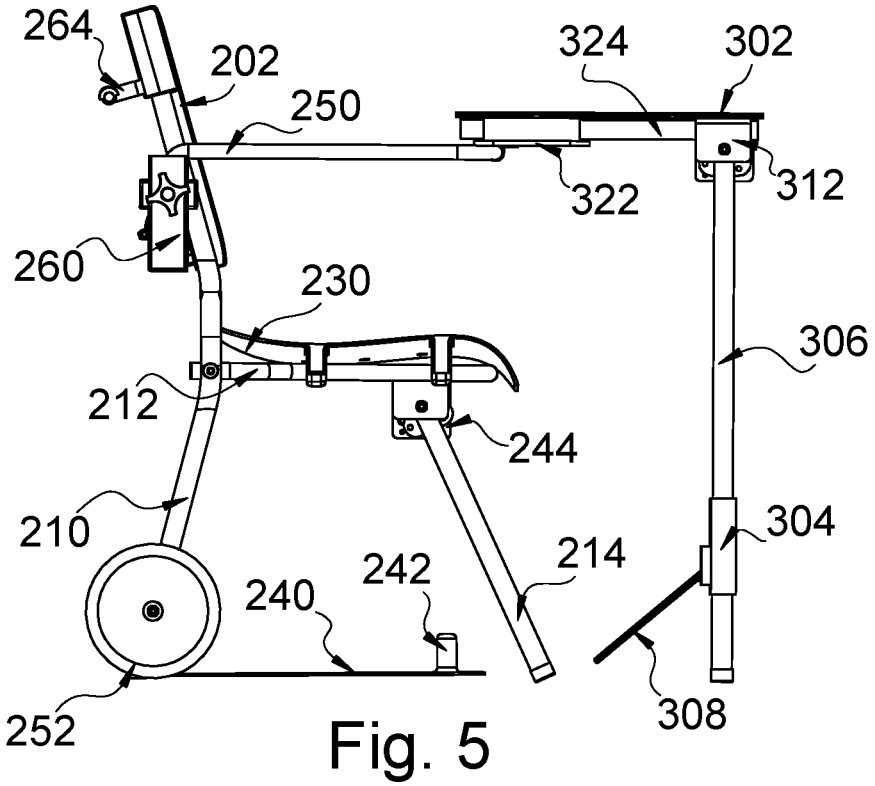
FIG. 5 is a side view of the mobile desk system deployed in flat desk configuration in an exemplary embodiment.
Figure 12:
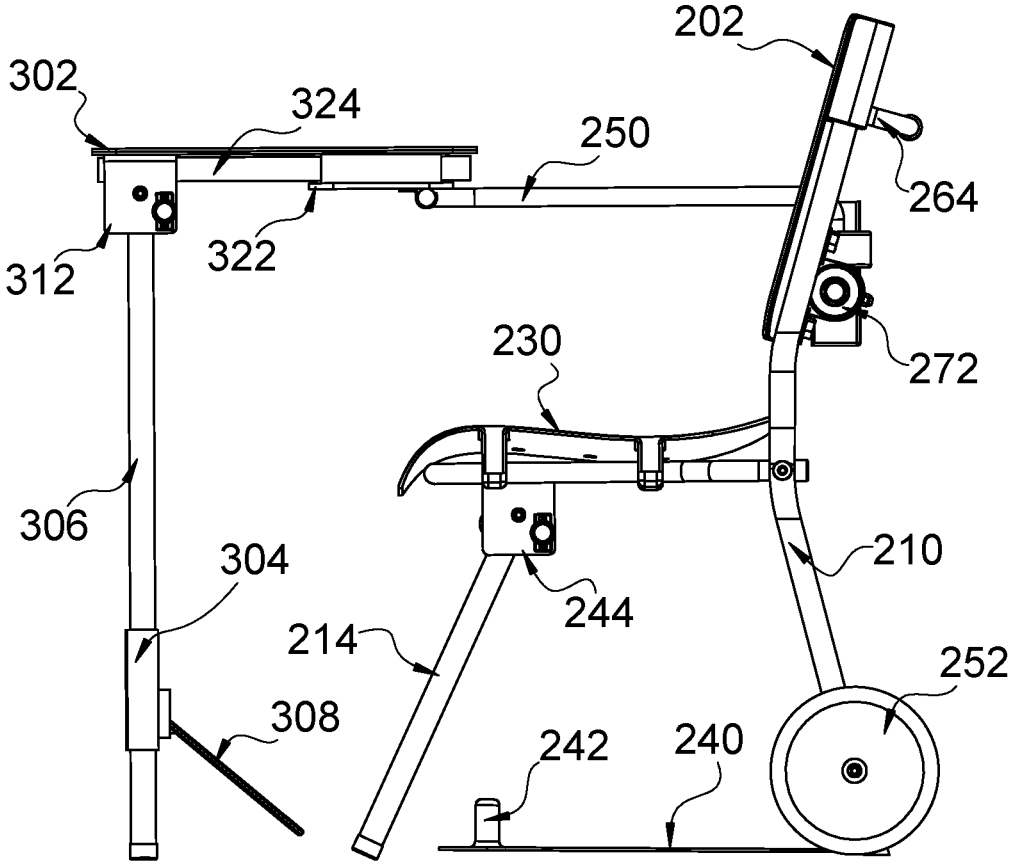
FIG. 12 is a side view of the mobile desk system deployed in flat desk configuration in an exemplary embodiment.

As illustrated in FIG. 1A, the mobile desk system 100 when fully deployed creates a collapsible seat 200 and a collapsible desk 300. A basket 400 used to transport items may be detached and separated as shown in FIG. 1A and FIG. 1B, or kept under the collapsible seat 200. FIGS. 5 and 12 illustrate this deployed system from opposite sides.

Figure 2:
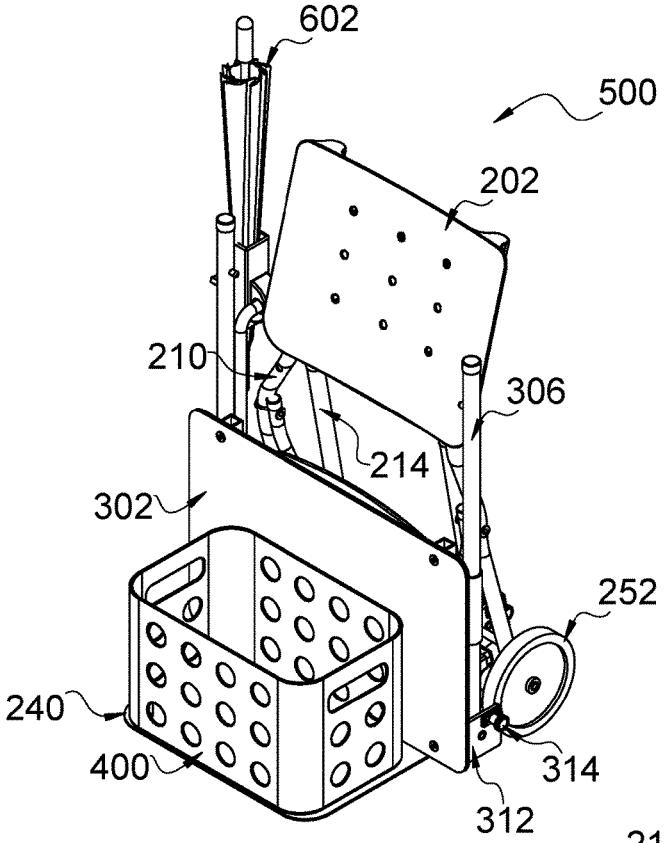
FIG. 2 is a perspective view of the mobile desk system and bucket in a transport configuration in an exemplary embodiment.
Figure 3:
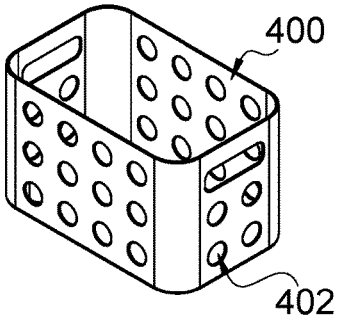
FIG. 3 is a view of the basket used in an exemplary embodiment.
Figure 4:
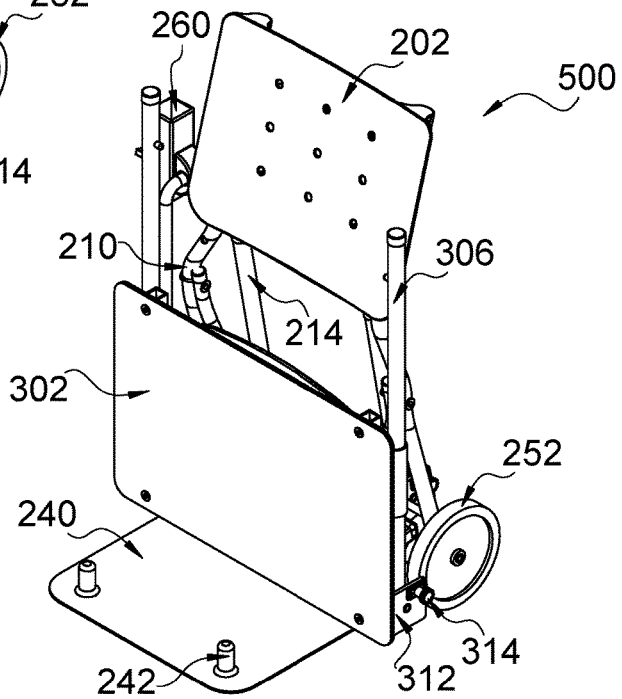
FIG. 4 is a perspective view of the mobile desk system without the bucket or umbrella in a transport configuration in an exemplary embodiment.
Figure 6:
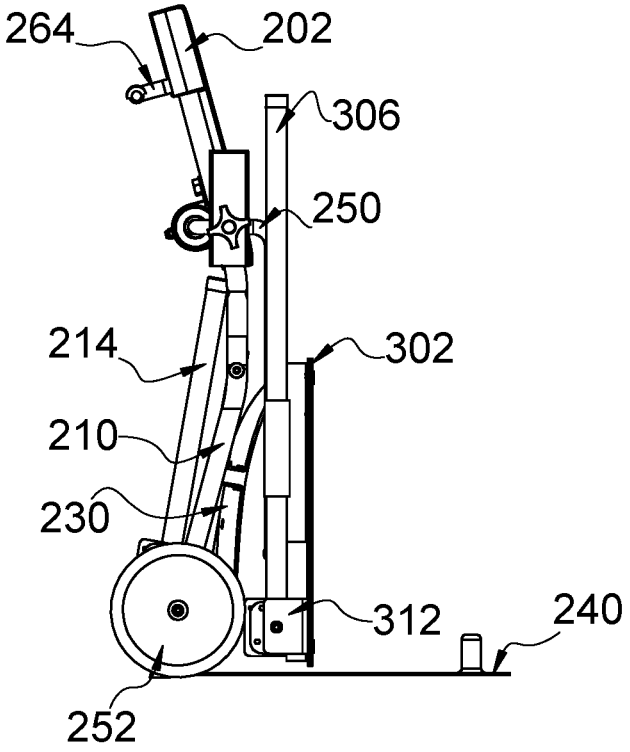
FIG. 6 is a side view of the mobile desk system in a transport configuration without a basket in an exemplary embodiment.

The collapsible seat 200 and collapsible desk 300 of the mobile desk system 100 in an exemplary embodiment can combine to form an integrated transport unit 500 shown in FIG. 2. The transport unit 500 is an upright and mobile unit that occupies a minimal amount of surface area (or footprint) compared to the collapsible seat 200 and collapsible desk 300 when deployed. FIGS. 2, 4, and 6 illustrate the mobile desk system 100 in an exemplary embodiment in a transport unit 500. FIGS. 4 and 6 shows the transport unit 500 absent a basket 400 that is shown alone in FIG. 3.

Collapsible Seat

The collapsible seat 200 has multiple elements, including a sitting surface 230, a primary seat support 212, a secondary seat support 210, and tertiary seat support 214. An optional element includes a base plate 240 that is coupled to the bottom of the secondary seat support 210. Optional elements in the exemplary embodiment also include a seat back 202 with a handle 264 for use when the transport unit 500 is in use. An additional option includes an umbrella 602 in an umbrella holder 260. FIG. 1B illustrates an alternative embodiment where the collapsible desk 300 is free standing from the collapsible seat 200. In FIG. 1B, the collapsible desk 300 is in an angled desk orientation.

The sitting surface 230 is coupled to the primary seat support 212 as shown in FIG. 1A. In an exemplary embodiment, the secondary seat supports 210 are designed to become perpendicular to the primary seat support 212 when the collapsible seat 200 is deployed. Near the base of the secondary seat supports 210 are a set of one or more wheels 252. The locations of the wheels 252 with respect to the base plate 240 in an exemplary embodiment allows different functionality when the collapsible seat 200 is oriented in a particular manner. The wheels 252 rise off the surface and the base plate 240 lies flat against the surface when the collapsible seat 200 is deployed. When the mobile desk system 100 becomes the transport unit 500, the operation of the handle 264 allows the base plate 240 to rise off the ground when acted on by the user, causing the wheels 252 to come into contact with the ground for transport.

Figure 13:
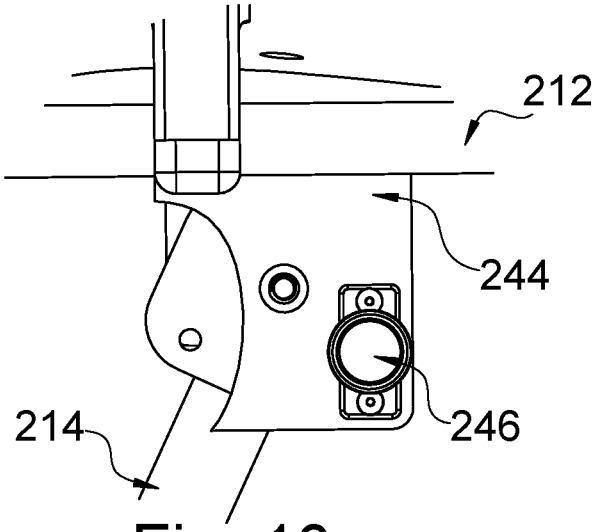
FIG. 13 is a side view of the front seat bracket with a tertiary seat support in a deployed configuration in an exemplary embodiment.

In addition to the secondary seat supports 210, the collapsible seat 200 is further supported by tertiary seat supports 214 that deploy from a front seat bracket 244 near the front of the sitting surface 230 as shown in FIG. 13. The tertiary seat supports 214 may rotate from a front seat bracket 244 that fixes the tertiary seat supports 214 in either a stored configuration parallel to the primary seat support 212, or in a deployed configuration by rotating approximately 90 degrees. In an exemplary embodiment, the primary seat support 212 couples to a front seat bracket 244 that in turn controls to the orientation of the tertiary seat support 214. The front seat plunger 246 is operated until the tertiary seat support 214 is in position and then locked by releasing the front seat plunger 246 on the front seat bracket 244. The process is reversed to return the tertiary seat supports 214 to a stored position when needed.

The collapsible seat 200 in an exemplary embodiment also has an umbrella holder 260 designed to hold an umbrella 602 in multiple orientations. The umbrella holder 260 is mounted on a lateral coupler 250 shown in FIG. 16 which is in turn coupled to a joint 272 fixed to a secondary seat support 210. The umbrella holder 260 allows the umbrella 602 to be oriented in multiple positions as needed.

Figure 18:
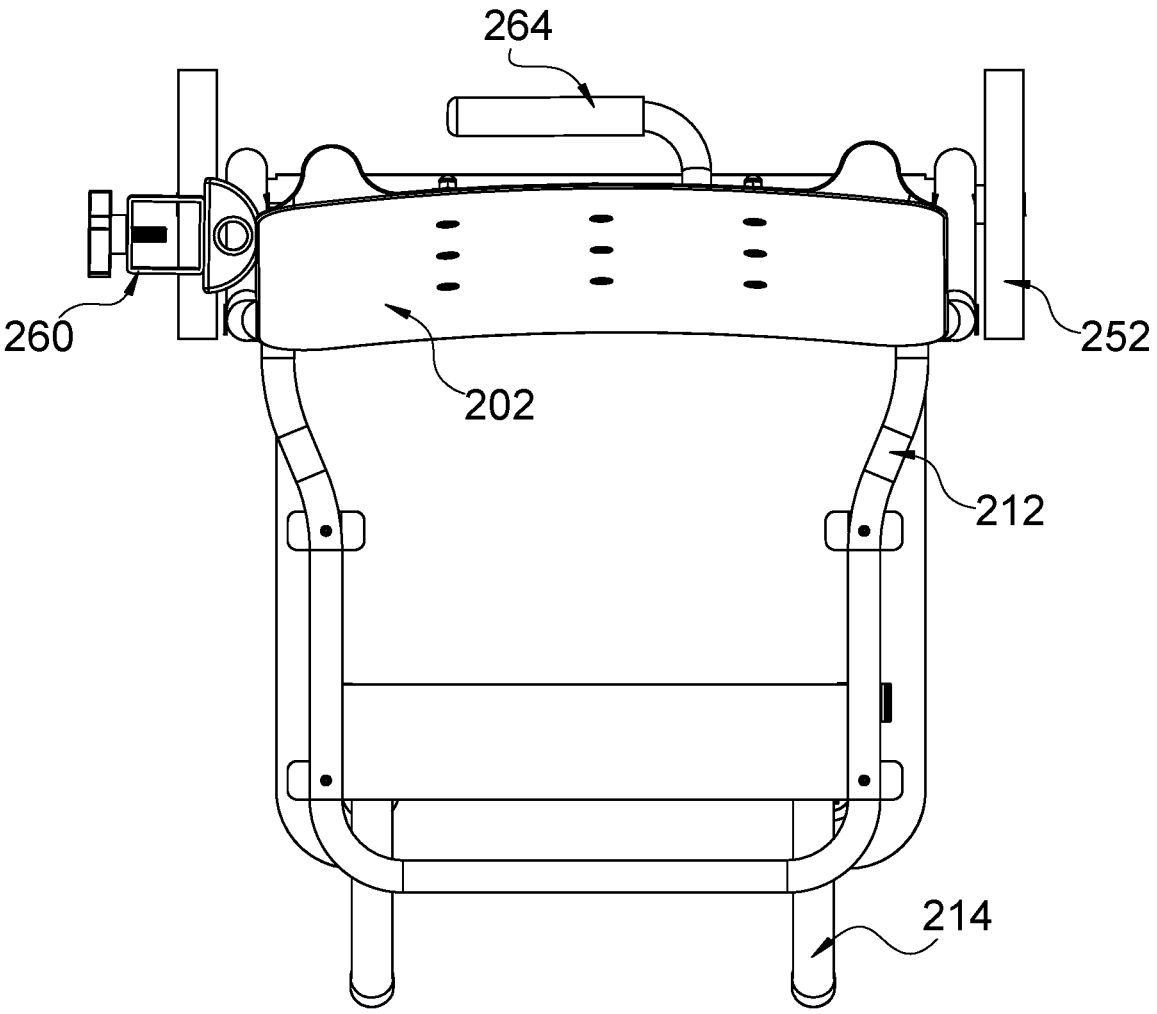
FIG. 18 is a top down view of the collapsible seat with the sitting surface removed in an exemplary embodiment.
Figure 19:
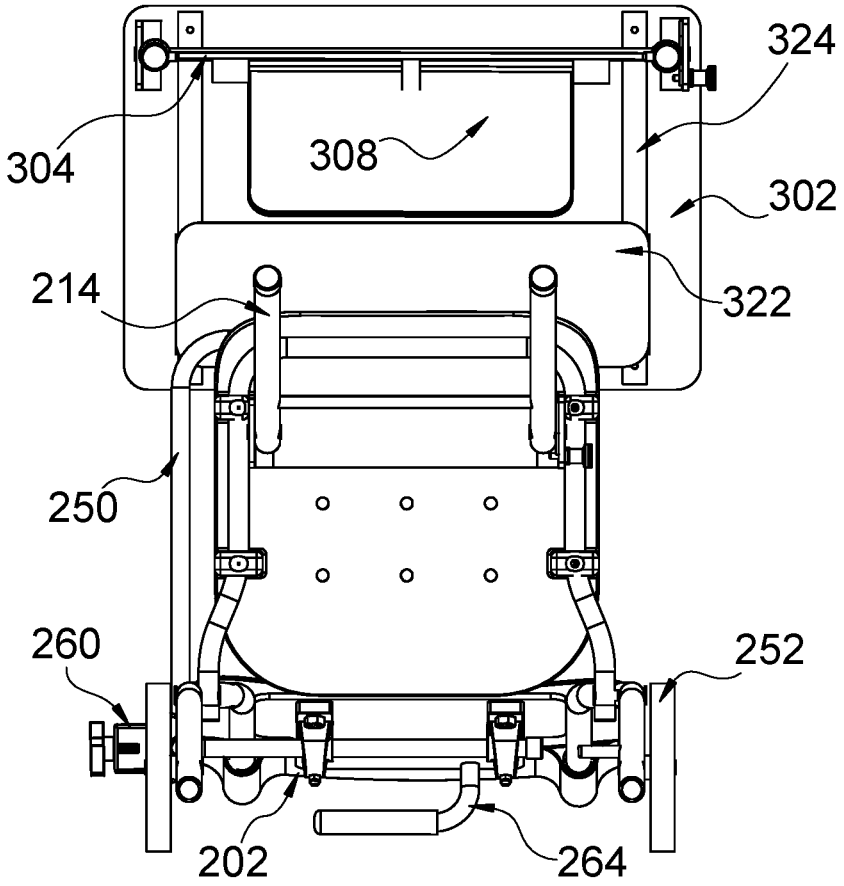
FIG. 19 is a bottom up view of the mobile desk system deployed in flat desk configuration in an exemplary embodiment.

FIG. 18 illustrates the collapsible seat 200 deployed configuration from a top down view. The sitting surface 230 is removed to show the primary seat support 212 and tertiary seat supports 214.

Figure 8:
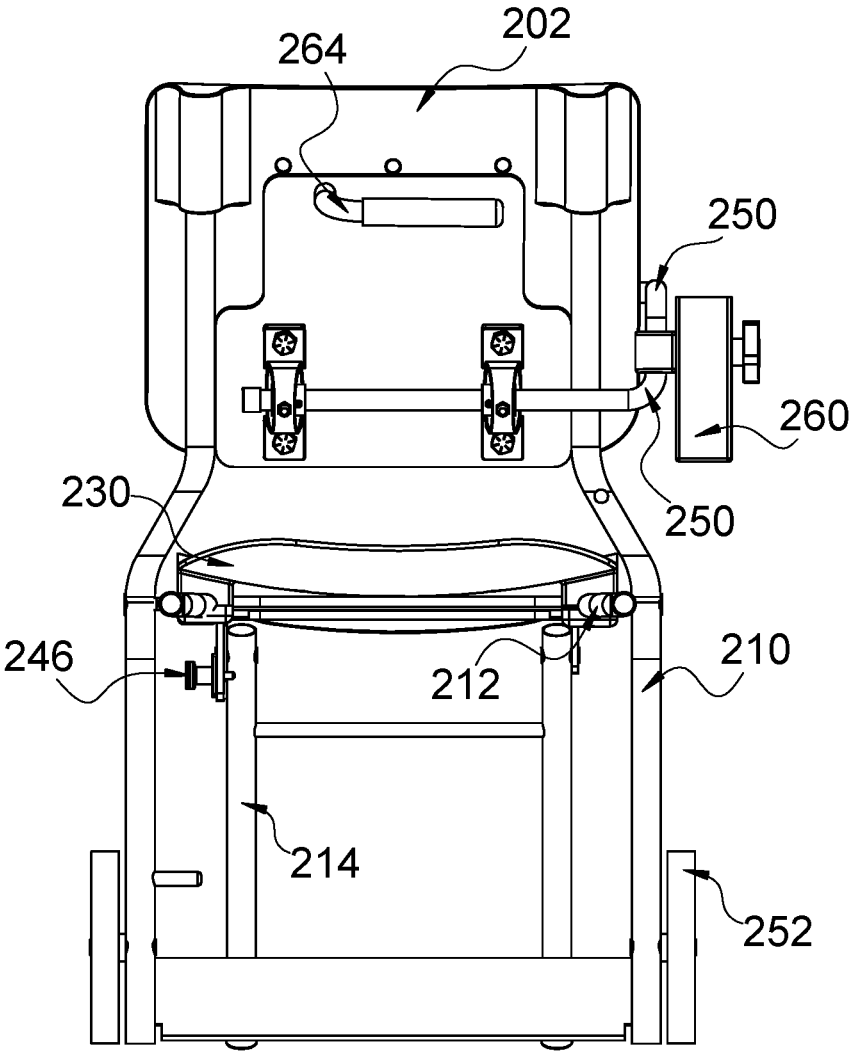
FIG. 8 is a rear view of the collapsible chair in a deployed configuration in an exemplary embodiment.
Figure 9:
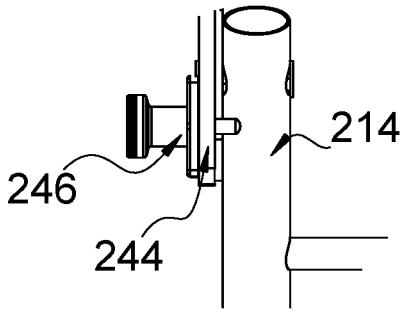
FIG. 9 is an isolation view of the front seat bracket interfaced with a tertiary seat support in a deployed configuration in an exemplary embodiment.

FIG. 8 shows the collapsible seat 200 viewed from the rear, showing the handle 264 and the front seat bracket 244 to keep the tertiary seat supports 214 in place. FIG. 9 shows the front seat plunger 246 in a fixed orientation. By retracting the front seat plunger 246 from the front seat bracket 244, the tertiary seat supports 214 can rotate and then be fixed in either the stored or deployed position as the user requires.

Figure 15:
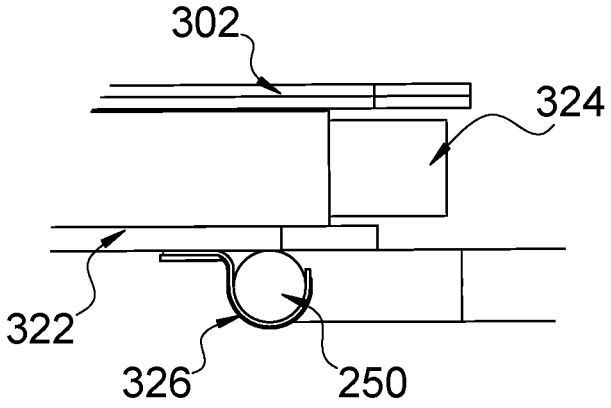
FIG. 15 illustrates the connection between the collapsible desk and the collapsible chair in an exemplary embodiment.
Figure 16:
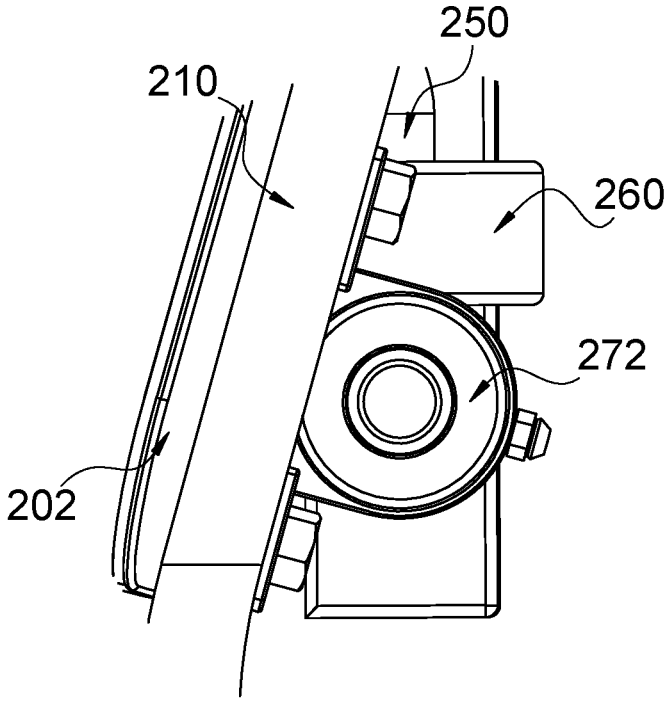
FIG. 16 illustrates a joint used to orient an umbrella in an exemplary embodiment.
Figure 17:
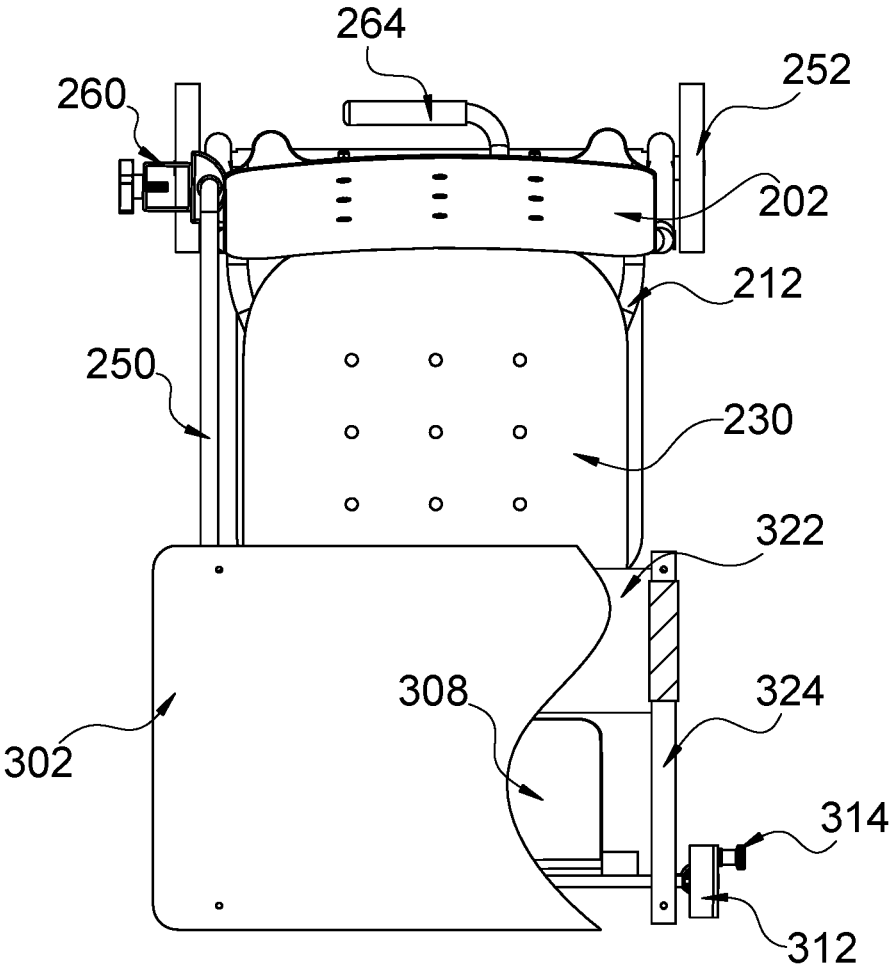
FIG. 17 is a top down view of the mobile desk system deployed in flat desk configuration in an exemplary embodiment with part of the work surface cut away.

In the exemplary embodiment, the lateral coupler 250 is coupled to the rear of the seat back 202 as shown in FIG. 8. The lateral coupler 250 may rotate in any direction allowed by the joint 272 , but is typically in one of two orientations: stored or deployed. When deployed, the lateral coupler 250 couples to the underside of the work surface 302 shown in FIG. 15. If the lateral coupler 250 couples to the collapsible desk 300, then the lateral coupler 250 fixes the distance between the collapsible seat 200 and the collapsible desk 300, while also acting as an armrest for use as shown in FIGS. 15, 16, and 17. When stored, the later coupler 250 may be substantially below the sitting surface 230 as shown in FIG. 1B. The lateral coupler 250 may also be used as a fastener as discussed below.

Desk

Figure 10:
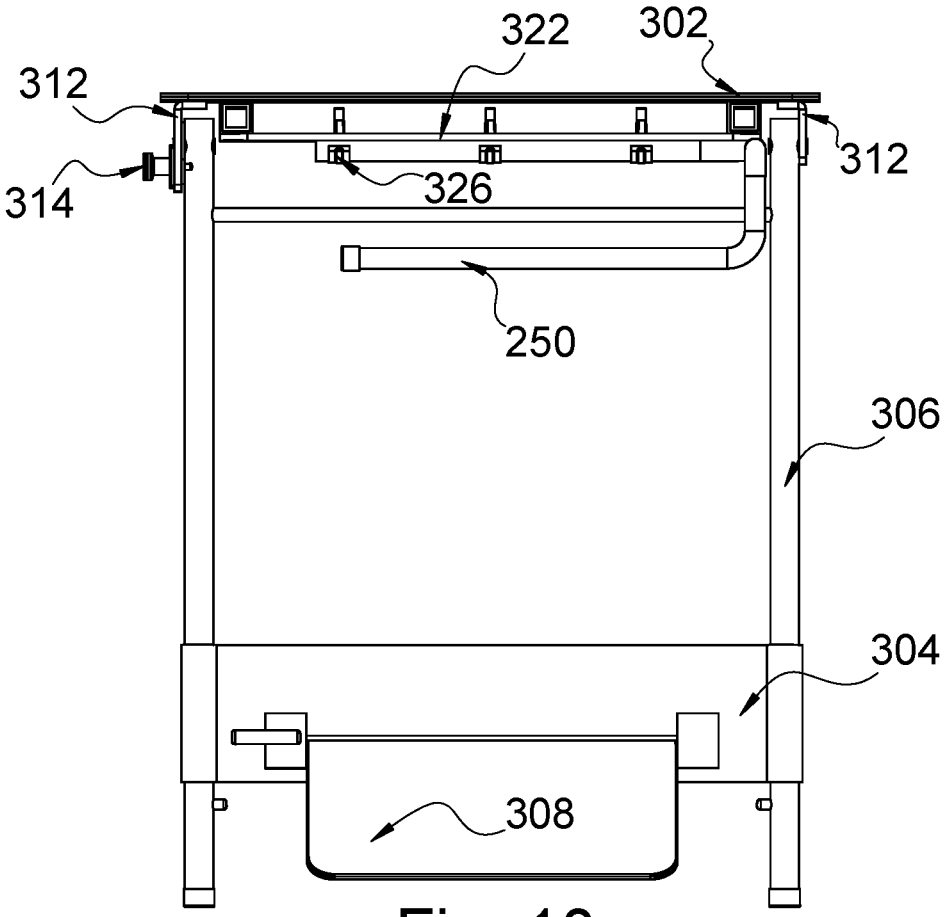
FIG. 10 is a rear view of the collapsible desk deployed in a flat desk configuration in an exemplary embodiment.
Figure 11:
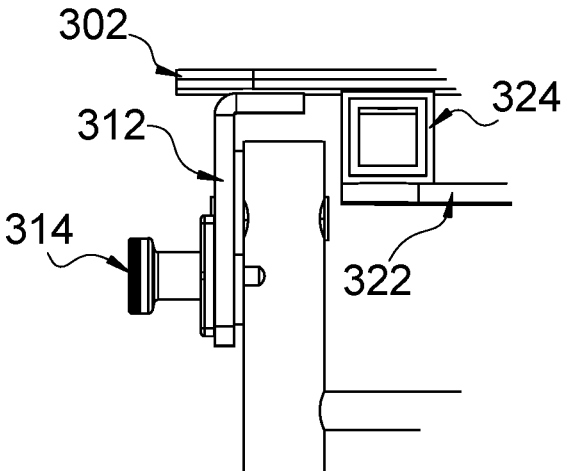
FIG. 11 is an isolation view of the desk bracket with a longitudinal table support in a deployed configuration in an exemplary embodiment.
Figure 14:
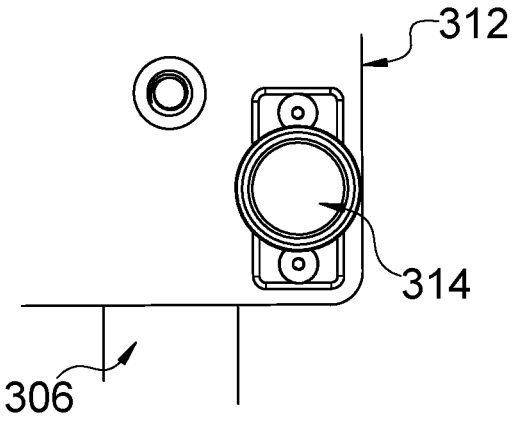
FIG. 14 is a side view of the desk bracket with a longitudinal table support in a deployed configuration in an exemplary embodiment.
Figure 20:
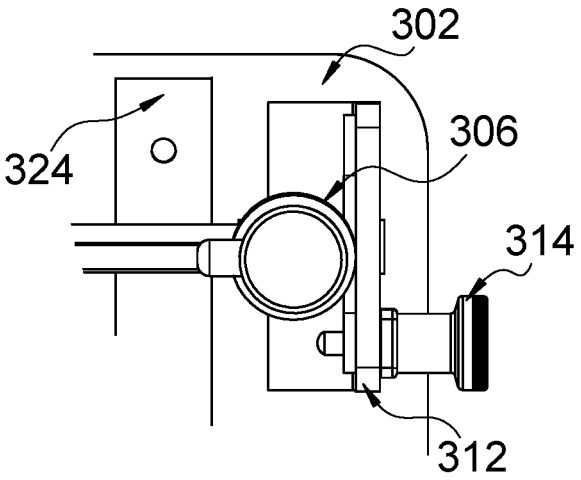
FIG. 20 is a bottom up view of the table bracket interfaced with a longitudinal table support in a deployed configuration in an exemplary embodiment.
Figure 21:
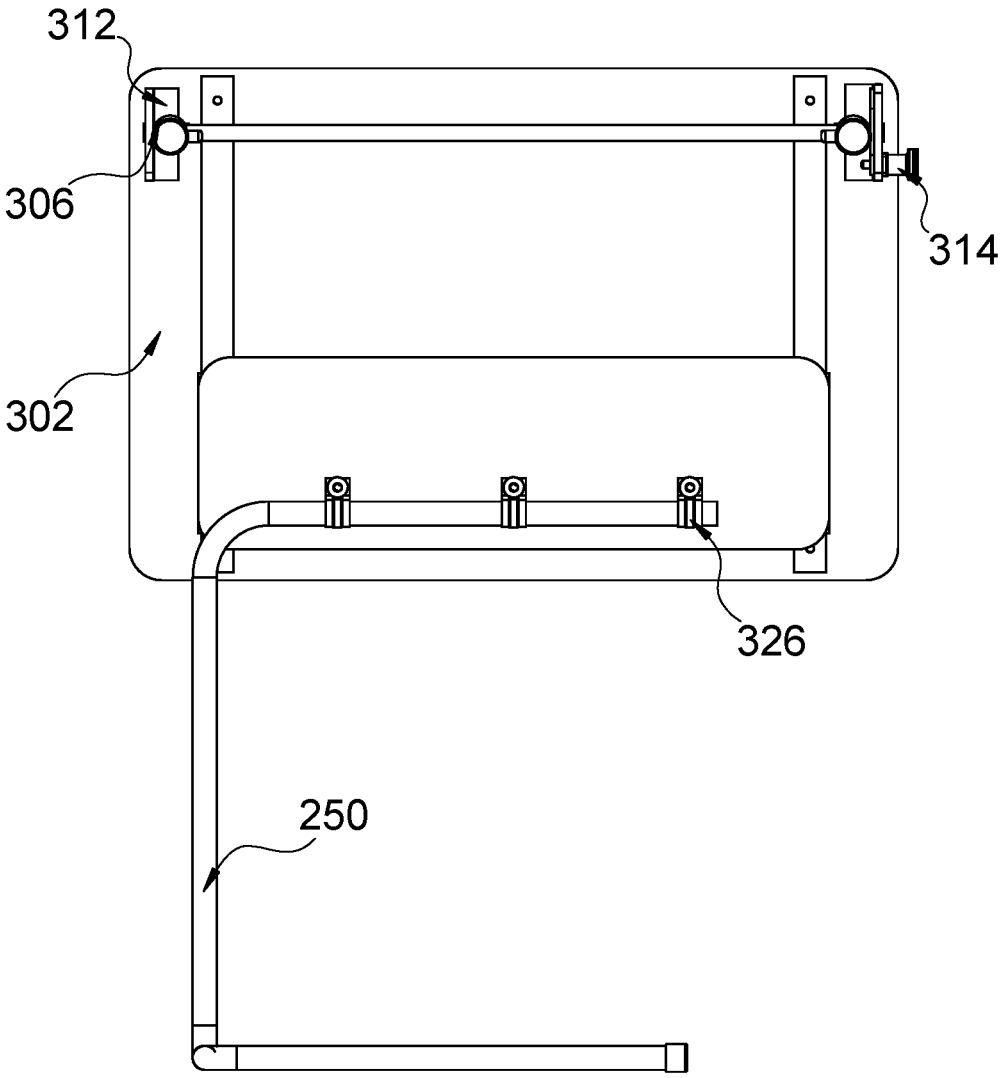
FIG. 21 is a view of the desk element from the bottom with leg elements and connected to the lateral coupler in an exemplary embodiment.

The collapsible desk 300 has multiple elements as shown in FIG. 10. The work surface 302 has a set of longitudinal desk supports 306 that rotate from the work surface 302 from a parallel orientation when stored as shown in FIG. 2 into a perpendicular orientation when deployed as shown in FIGS. 11 and 20. Control of the orientation of the longitudinal desk supports 306 occurs with the desk bracket 312 shown in FIG. 14. The desk bracket plunger 314 is operated to orient the longitudinal desk support 306 between 0 and 90 degrees, and then released to lock it in place. Toward the distal end of the longitudinal desk supports 306 is a footrest 304. The footrest 304 comprises an auxiliary support 308 that can deploy making the collapsible desk 300 without external supports.

The collapsible desk 300 may also have a rail system 324 installed under the work surface 302. This rail system 324 may be used to facilitate a slider base 322 which may be used to increase the available work area and adjust the distance between the work surface 302 and the user. FIG. 11 illustrates the rail system 324 along with the desk bracket 312, while FIG. 17 shows the slider base 322 with the work surface 302 removed.

Figure 7:
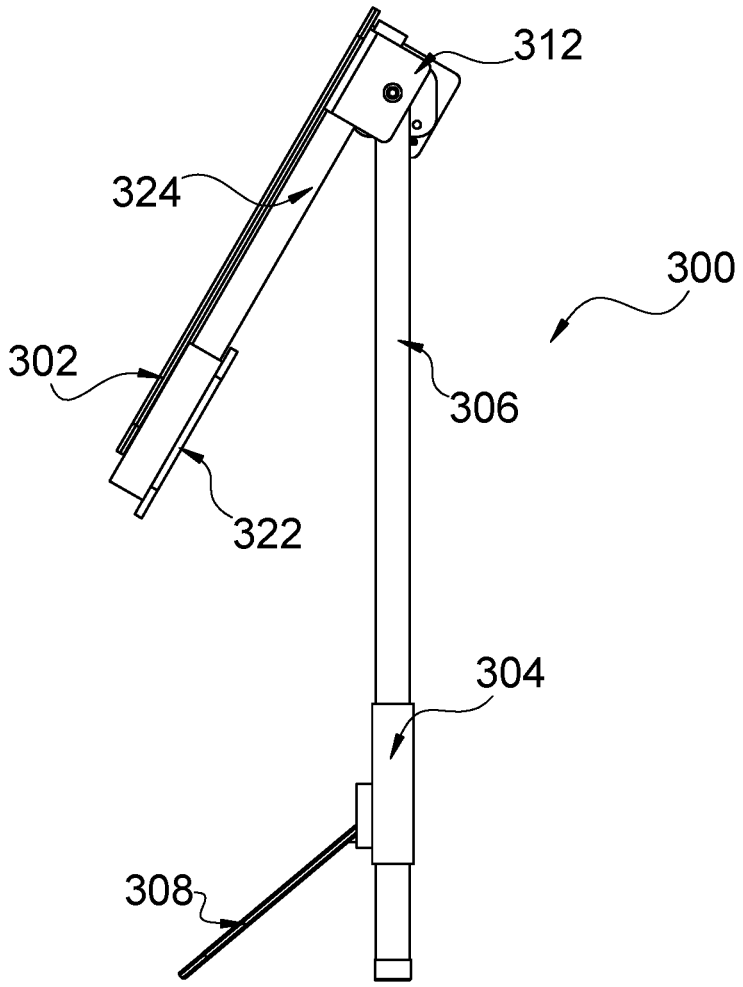
FIG. 7 is a side view of the collapsible desk in an angled desk configuration in an exemplary embodiment.

In an alternate exemplary embodiment, the collapsible desk 300 is freestanding. In the alternate exemplary embodiment, the work surface 302 may be at an angle as opposed to being parallel to the ground as controlled by the desk bracket 312 as shown in FIG. 7. The auxiliary support 308 deploys to provide stability. Transport In operations, the transport unit 500 is transported to the location where the user wants to deploy the mobile desk system 100. The user grabs the handle 264 and causes the transport unit 500 to tip so that it may freely roll on the wheels 252. In operations it acts much like a hand truck as shown in FIG. 2. Items may be placed in the basket 400 for transport. These may include, but are not limited to files, electronic equipment, and art supplies. The basket 400 is held in place with at least one base plate projection 242 entering through projection apertures 402 on multiple sides of the basket 400. Once at the desired location, the handle 264 is released and the transport unit 500 stands in the upright position. Alternately, it may be placed in a prone position along the ground if needed.

Deployment

The exemplary embodiment begins in the transport unit 500. The collapsible desk 300 and collapsible seat 200 are designed to be coupled together in a manner that minimizes the volume occupied by the outer surface of the resulting transport unit 500. In an exemplary embodiment, the collapsible desk 300 couples to the collapsible seat 200 in a secure yet detachable manner. Any coupling mechanism known to those skilled in the art may be used. In an exemplary embodiment, the collapsible desk 300 is placed adjacent to the collapsible seat 200 such that the collapsible seat 200 and said collapsible desk 300 may come in contact and become coupled and will remain so until released by the user.

In an exemplary embodiment, when the collapsible seat 200 is in a storage configuration, part of the lateral coupler 250 is oriented when it is co-located adjacent to where the work surface 302 if the collapsible desk 300 would be located. The lateral coupler 250 may connect with the collapsible desk 300 either by connecting to the underside of the work surface 302, the rail system 324, or the slider base 322. The coupling in the exemplary embodiment involves screws that pass through the lateral coupler 250 and interface with the collapsible desk 300 in collapsed configuration. Any fastener may be use without departing form the scope of the invention.

The fasteners coupling the collapsible desk 300 to the collapsible seat 200 are released when the user deploys the mobile desk system 100. Once the collapsible desk 300 is released from the collapsible seat 200, the longitudinal desk supports 306 are released from the underside of the work surface 302. The longitudinal desk supports 306 may rotate freely or require external manipulation reach the correct position. The angle between the work surface 302 and the longitudinal desk supports 306 dictate the angle of the work surface 302 when the collapsible desk 300 is in use. The user engages the desk bracket plunger 314 on the desk bracket 312 to put the work surface 302 in the desired orientation, which can be anywhere from 0 to 90 degrees. The user can either place the collapsible desk 300 on the ground to prepare the collapsible seat 200, or can deploy the auxiliary support 308 to make the collapsible desk 300 freestanding, similar to a drafting table.

In an exemplary embodiment, the primary seat supports 212 connect to a sitting surface 230. When collapsed, the collapsible seat 200 begins with the sitting surface 230 parallel to the primary seat supports 212, secondary seat supports 210, and tertiary seat supports 214. The collapsible seat 200 is placed upright when deployed, resting on the surface with the base plate 240 parallel to the ground and bearing all the weight. The rotation of the primary seat support 212 causes the sitting surface 230 to also become parallel to the ground and perpendicular to the secondary seat support 210. The user releases the front seat brackets 244 to allow the tertiary seat supports 214 to rotate to become perpendicular to the ground.

In an alternate exemplary embodiment, the collapsible desk 300 and collapsible seat 200 connect by use of the lateral coupler 250 as shown in FIG. 1A. The lateral coupler 250 attaches to the collapsible desk 300 by means of connectors 326 that couple the lateral coupler 250 to the collapsible desk 300 under the work surface 302.

With the collapsible seat 200 and collapsible desk 300 separated and deployed, they may operate together or independently. A coupled configuration involves the collapsible seat 200 and the collapsible desk 300 coupled to each other by the later coupler 250 as shown in FIG. 1A, fixing the distance between the collapsible seat 200 to use the collapsible desk 300.

An independent configuration involves the collapsible seat 200 and the collapsible desk 300 not coupled to each other, allowing the user sitting on the collapsible seat 200 to use the collapsible desk 300 at various angles. In such a configuration, both the collapsible desk 300 and collapsible seat 200 remain freestanding as shown in FIG. 1B.

An additional exemplary embodiment includes a power supply under the work surface 302. This power supply may be connected to any mobile electronic devices needed. It may also connect to an external power source to recharge. This allows the user to use portable electrical equipment away from fixed power sources.

In an additional alternate embodiment, the secondary seat supports 210, tertiary seat supports 214, seat back 202, and longitudinal desk support 306 may be adjustable length. The secondary seat supports 210, tertiary seat supports 214, and longitudinal desk supports 306 may be designed in a manner that they can extend or retract as needed to accommodate the user's height, while the seat back 202 may be adjusted for user comfort.

While a collapsible seat 200 has been discussed with a seat back 202, this invention could also use a stool with no seatback without departing form the scope of this invention.

One of skill in the art will appreciate that embodiments of the invention provide improvements to work areas by way of making furniture more portable. Although specific embodiments are illustrated and described herein, it will be appreciated by those of ordinary skill in the art that any arrangement which is calculated to achieve the same purpose can be substituted for the specific embodiments shown. This specification is intended to cover any adaptations or variations of embodiments. In particular, one of skill in the art will appreciate that the names and terminology are not intended to limit embodiments. Furthermore, additional apparatus can be added to the components, functions can be rearranged among components, and new components corresponding to future enhancements and future physical devices used in embodiments can be introduced without departing from the scope of the invention. The terminology used in this application is intended to include all embodiments and alternatives which provide the same functionality as described herein.

The invention claimed is:

1. A mobile desk system, comprising:

a convertible seat that may be in at least one of:
- a deployed seat mode for a user to sit on; and
- a collapsed seat mode to facilitate transport;

a convertible desk that may be in at least one of:
- a deployed desk mode for a user to use for work; and
- a collapsed desk mode to facilitate transport;

wherein:
- said convertible seat in said collapsed seat mode attached to said convertible desk in said collapsed desk mode constitutes an integrated mobile unit facilitating transport; and
- said convertible seat comprises: a sitting surface, at least one primary seat support, at least one secondary seat support, and a base plate attached to a distal end of said at least one said secondary seat support;
- wherein the at least one said primary seat support is attached to said sitting surface;
- wherein the at least one said secondary seat support is attached to at least one said primary seat support to provide support for said sitting surface;
- wherein said base plate further comprises at least one base plate projection;
- wherein said mobile desk system is equipped with a container that is detachably engaged with at least one said base plate projection; and
- said convertible desk is reversibly detachable such that said convertible desk may be used for work in a freestanding arrangement.

2. The mobile desk system of claim 1, wherein:

said integrated mobile unit occupies an area no larger than the length and width of said convertible seat in said collapsed seat mode.

3. The mobile desk system of claim 1, wherein:

said integrated mobile unit occupies an area no larger than the length and width of said convertible desk in said collapsed desk mode.

4. The mobile desk system of claim 1, wherein:

said convertible desk comprises:
- a work surface;

at least one longitudinal desk support coupled to said work surface; and an adjustable desk coupler capable of coupling said at least one longitudinal desk support to said work surface.

5. The mobile desk system of claim 4, wherein said adjustable desk coupler may orient said work surface at multiple orientations with respect to said at least one longitudinal desk support.

6. The mobile desk system of claim 1, wherein said convertible desk in said deployed desk mode and said convertible seat in said deployed seat mode are attached by a lateral desk coupler.

7. The mobile desk system of claim 1, wherein said convertible seat further comprises a seatback.

8. The mobile desk system of claim 1, wherein:

at least one said primary seat support and at least one said secondary seat support are attached by an adjustable seat coupler that facilitates orienting at least one said primary seat support and at least one said secondary seat support in multiple orientationsi said adjustable seat coupler has a collapsed orientation in said collapsed seat mode; and said adjustable seat coupler has a deployed orientation in said deployed seat mode.

9. The mobile desk system of claim 1, further comprising at least one wheel-attached to said distal end of said secondary seat support.

* * * * *